US005333669A

United States Patent [19]

Erana

[11] Patent Number: 5,333,669

[45] Date of Patent: Aug. 2, 1994

[54] CORESHOOTERS FOR SELF-SETTING PROCESS WITH VACUUM SYSTEM

[76] Inventor: Agustin Erana, Poligono Industrial Ali-Gobeo, Zorrostea, 4, 01010 Vitoria (Alava), Spain

[21] Appl. No.: 33,318

[22] Filed: Mar. 15, 1993

[30] Foreign Application Priority Data

Mar. 16, 1992 [ES] Spain ..... 9200572

[51] Int. Cl.[5] ..... B22C 13/12; B22C 15/22

[52] U.S. Cl. ..... 164/160.1; 164/195; 164/200

[58] Field of Search ..... 164/160.1, 160.2, 186, 164/195, 200, 201

[56] References Cited

U.S. PATENT DOCUMENTS 4,089,362 5/1978 Edwards ..... 164/195 X

FOREIGN PATENT DOCUMENTS 0128974 12/1984 European Pat. Off. ..... 164/201

2206672 8/1973 Fed. Rep. of Germany ..... 164/200

2833999 2/1980 Fed. Rep. of Germany ..... 164/195

48-38290 11/1973 Japan ..... 164/201

57-195559 12/1982 Japan ..... 164/160.1

1-273648 11/1989 Japan ..... 164/200

*Primary Examiner*—J. Reed Batten, Jr.

*Attorney, Agent, or Firm*—Helfgott & Karas

[57] ABSTRACT

A coreshooter includes a table on which a corebox for molding articles is positioned, and a blowing cartridge supplying sand into the corebox. The corebox is housed in a bell which forms about the corebox a chamber. The bell is fitted with a connection to a vacuum pump. A valve is provided between the cartridge and the interior of the corebox. Prior to the opening of the valve which causes the blowing cartridge to discharge sand into the corebox vacuum is provided inside the corebox through holes therein for expelling the air. The vacuum considerably enhances the discharge of the blowing cartridge even when highly complex or sizeable cores are made without having to use special blowing nozzles or heads.

2 Claims, 1 Drawing Sheet

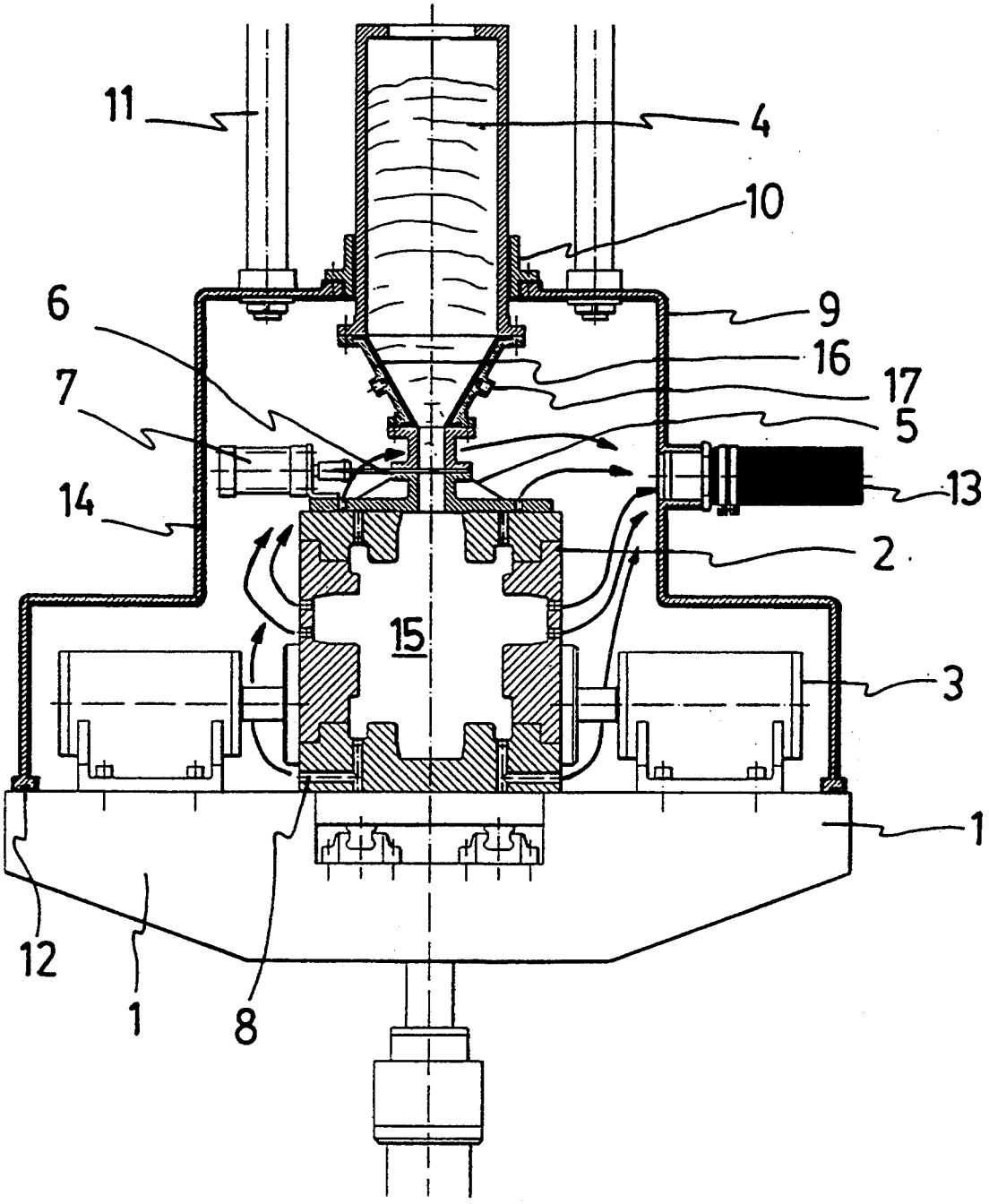
11
4
10
6
9
16
7
17
5
14
13
2
15
3
1
12
1
8

CORESHOOTERS FOR SELF-SETTING PROCESS WITH VACUUM SYSTEM

FIELD OF THE INVENTION

The present invention relates to a number of improvements in core-shooting machines operated with a self-setting process, which improvements are designed to allow a single universal blowing plate, even when highly complex and/or sizeable cores are to be obtained, and to prevent the sand-additives self-setting mixture from hardening which would impair shooting efficiency and hence driving of the sand into the corebox.

BACKGROUND OF THE INVENTION

It is well-known that in a conventional core-shooting machine the corebox is located on the so-called working table, which table is hydraulically provided with upward and downward movement. The blowing cartridge is in turn provided on the corebox, loaded with the measure of sand and binding additives required to fill the box and obtain the desired core. The blowing head (not shown) is provided on the blowing cartridge to cause the release of the air-blast which reaches into the cartridge and drives the sand from the same into the corebox, once the three parts, namely corebox-cartridge-blowing head are tightly coupled when the air is released.

Depending on whether the process is in a hot or a cold box, heat is provided to the boxes or else they are gassed in order to cause the binding material to be polymerized and hence the core produced to be hardened, thereupon to be removed from the box.

In the so-called self-setting process, the sand is mixed by additives that are able to cause self-setting within a short period of time (one second) and the casting process begins almost in the actual cartridge, whence if the release of the air-blast is delayed only slightly the outlet of the cartridge may be blocked and the discharge of the sand impaired or at least is not fully effected.

In the above conventional shooters, between the cartridge carrying the measure of sand and the corebox, the so-called blowing plate is provided, fitted with a number of nozzles for the sand to reach the box through selected points, in accordance with the geometric and dimensional characteristics and the complexity of the core to be made, viz. the inner voluble of the corebox which must be uniformly filled with sand, reaching all its corners. Each blowing plate will therefore be studied for a given corebox so that a change of box will entail a change of blowing plate, which poses no serious problem in mass productions or large series, for the box changes take place over long time spreads.

However, when in small productions, short series, the boxes are changed frequently and therefore so is the blowing plate, which means that a considerable amount of production time is wasted due to the handling operations required.

Furthermore, when complex or sizeable cores are to be obtained in a process known as self-setting, the conventional core-shooting machines can prove inefficient, either because they are not able to fully and evenly fill the corebox, or because part of the sand remains in the cartridge because the setting process shall have begun therein, and the air-blast released shall have been insufficient to drive the mixture entirely.

SUMMARY OF THE INVENTION

More specifically and in order to advoid the above disadvantages, the coreshooting machine comprises a bell that is slidingly and tightly mounted on a blowing cartridge, coaxial therewith and also capable of being coupled tightly to a working table in the machine, making up a sealed housing in which the corebox is housed, said bell being connected to a vacuum source which is applied thereto before the air-blast is released through the blowing head, which air causes the cartridge to discharge. Thus, the vacuum established in the bell is also transmitted into the corebox through the air expelling holes with which the latter is fitted.

In accordance with the above, when the valve isolating the cartridge from the corebox is opened, the discharge of the sand or self-setting mixture is made not only by the drive of the air-blast reaching into the cartridge from the blowing head, but also by the actual depression or vacuum existing in the corebox, which ensures a swift and even spreading of the self-setting mixture throughout the inner volume of the box, reaching and filling the most remote accesses.

Finally, and in accordance with another embodiment of the invention, the lower cup-shaped part of the blowing cartridge has been provided to have an inner membrane, which is made to vibrate by an air connection, in order to enhance the discharge of the cartridge into the corebox, preventing sand in an advanced stage of setting from accumulating at the outlet mouth of the cartridge and removing the self-setting mixture from such choked area.

In accordance with the invention it is possible for the discharge from the blowing cartridge to be efficient, since the shooting pressure and the inner pressure in the corebox are joined to each other, to ensure a perfect definition and homogenization of the core obtained. Furthermore, the same blowing plate is used for all coreboxes, with the time savings this entails.

DESCRIPTION OF THE DRAWINGS

In order to provide a fuller description and contribute to the complete understanding of the characteristics of this invention, a single figure of drawings which is diagrammatic and not fully comprehensive, partially shows a cross-sectional lateral view of the core-shooting machine in accordance with the present invention, showing the part of the machine including the working table, corebox and blowing cartridge.

DESCRIPTION OF THE PREFERRED EMBODIMENT OF THE INVENTION

In view of the figure of the drawing, it can be observed that a coreshooting machine for conventional casting includes a vertically displaceable table (1) receiving the corebox (2) which is duly fixed in the working position, for instance by means of clamps (3), and is operatively facing a blowing cartridge (4) that may be coupled to the top of the corebox (2), with a blowing plate (5) fitted in between, a valve being established between the cartridge (4) and the blowing plate (5), for instance a guillotine valve (6) driven by the relevant cylinder (7). Once the blowing head is coupled to the cartridge, and the latter to the corebox, everything will be ready for the self-setting mixture in the cartridge to be discharged into the corebox, driven by the air-blast released by the blowing head.

The machine table (1) of the coreshooting machine of the present invention is provided with a removably-mounted bell (9), preferably provided with a guide bushing (10) which allows it to slide on the actual blowing cartridge (4), with a tight coupling in order to allow the elevation thereof and hence the possibility of handling the same on the area where the corebox (2) is disposed, whenever the stays (11) associated therewith are actuated by any suitable means. The bell (9) may in turn be tightly coupled to the machine working table (1), as shown by the figure, with the assistance of the relevant sealing joint (12).

The bell (9) has a connection (13) to a suitable vacuum bridge or pump, so that right before the release caused by the blowing head (not shown) and with the valve (6) shut-off and the bell (9) supported by the table (1), defining a tight chamber (14), the chamber (14) is provided with a vacuum which shall through the holes (8) of the corebox (2) also communicate with the inside (15) of the corebox, and therefore when the valve (6) is opened and at the same time the air-blast is released by the blowing head, the cartridge (4) discharges remarkably fast and advantageously, since two different and complementary forces are joined and combined, namely the air-blast reaching into the cartridge from above and the suction caused by the vacuum in the corebox (2), thereby allowing fast, total and homogeneous filling of the corebox and hence the perfect forming of the core that is to be obtained.

To complement the above structure the cup-shaped lower section of the blowing cartridge (4) is fitted with a membrane (16) covering the inside of the same and defining a perimetric chamber with the actual cartridge wall, which chamber communicates with the outside through one or several connections (17),through which air is sent into the chamber alternatively, to cause the membrane (16) to vibrate and thereby prevent the sand from blocking the choked cartridge area.

It is believed that the description need be extended no further for an expert in the art to grasp the full scope of the invention and the advantages it offers.

The materials, shape, size and layout of the elements may be altered provided that this entails no modification of the essential features of the invention.

The terms used to describe the invention herein should be taken to have a broad rather than a restrictive meaning.

I claim:

1. A coreshooter for self-setting molding process with a vacuum system, comprising a blowing cartridge, a blowing plate attached to said cartridge, a table, a corebox disposed on said table for receiving a sand discharge from said blowing cartridge through said blowing plate positioned on said corebox, a bell positioned on said table and enclosing said corebox and part of said cartridge coaxial therewith so as to form a chamber in said bell, said bell being tightly connected to said blowing cartridge and said table, respectively, and being fitted with a connection to a vacuum source to as to produce vacuum in said chamber of said bell, said corebox having gauged holes for communicating said chamber with an interior of said corebox for air to leave said corebox during a blowing stage, a valve fitted at said blowing plate to isolate said corebox from said blowing cartridge while airblast applied to said cartridge is released, at which point said valve is opened and sand discharge from said cartridge is enhanced by a thrust of air-blast in combination with vacuum provided in said corebox through said holes.

2. The coreshooter according to claim 1, wherein said blowing cartridge includes a cup-shaped lower section close to a mouth thereof, said section being fitted with a membrane which forms with an inner cartridge wall in said lower section a cup-shaped annular chamber which communicates with an outside through at least one connection through which air can be alternatively supplied into said annular chamber so as to cause said membrane to vibrate and thus prevent sand from blocking a choked cartridge area.

* * * * *